US006226941B1

(12) United States Patent
Stevens

(10) Patent No.: US 6,226,941 B1
(45) Date of Patent: May 8, 2001

(54) UNDERCOVER DECK DRAINAGE SYSTEM

(76) Inventor: Thomas M. Stevens, 751 Casteel Rd., Powder Springs, GA (US) 30073

( * ) Notice: Subject to any disclaimer, the term of this patent is extended or adjusted under 35 U.S.C. 154(b) by 0 days.

(21) Appl. No.: 08/811,766

(22) Filed: Apr. 6, 1997

(51) Int. Cl.[7] ..... E04B 1/70; E04D 13/04

(52) U.S. Cl. ..... 52/302.3; 52/533; 52/537; 52/650.3; 52/745.13; 52/748.1

(58) Field of Search ..... 52/11, 15, 302.3, 52/302.4, 533, 536, 537, 745.13, 748.1, 650.3

(56) References Cited

U.S. PATENT DOCUMENTS 3,417,519 * 12/1968 Hitter ..... 52/11
4,065,883 * 1/1978 Thibodeau ..... 52/11
4,411,109 * 10/1983 Struben et al. ..... 52/11
4,860,502 * 8/1989 Mickelsen ..... 52/11
5,511,351 * 4/1996 Moore ..... 52/11 X
6,050,030 * 4/2000 Wax, Sr. ..... 52/15

* cited by examiner

*Primary Examiner*—Christopher T. Kent
(74) *Attorney, Agent, or Firm*—Thomas, Kayden, Horstemeyer & Risley

(57) ABSTRACT

An undercover system for decks and the like which comprises at least a pair of spaced apart support assemblies and a plurality of cover members supported on the support assemblies to keep the area under the deck dry.

16 Claims, 4 Drawing Sheets

UNDERCOVER DECK DRAINAGE SYSTEM

BACKGROUND OF THE INVENTION

This invention relates generally to cover systems for spaces and more particularly to undercover systems for use in connection with decks to prevent water passing through the deck entering the space under the deck.

Decks enjoy widespread use today. One of the primary drawbacks in the use of decks is that the space under the deck is not maintained dry because the deck floor members are spaced apart to allow water to pass through the deck. This severely limits the use of the space under the decks. A number of different drainage systems have been suggested for use in keeping the water passing through the deck from wetting the space under the deck. Examples of these prior art systems are set forth in the following patents:

| U.S. Pat. No. | Inventor | Issue Date |
|---|---|---|
| 4,065,883 | L. T. Thibodeau | January 3, 1978 |
| 4,663,894 | A. R. LaRoche et al. | May 12, 1987 |
| 4,860,502 | M. M. Mickelsen | August 29, 1989 |
| 5,511,351 | G. M. Moore | April 30, 1996 |

All of these prior art attempts to provide an undercover system for decks have a common problem. That is, all require that the undercover system be permanently attached to the deck structure itself. This creates several problems. One problem is that the systems are difficult to locate on the deck structure in that they require that different sections of the system be individually aligned and attached. Another problem is that the undercover systems makes replacement of deteriorated members of the deck structure difficult and most times require at least partial disassembly of the undercover system for the repair of the deck structure. Yet another problem with these prior art undercover systems is that the spacing between the deck floor members allow debris to pass therethrough as well as water so that the undercover system becomes clogged with the debris. The prior art undercover systems do not provide a way to easily clean the accumulated debris off of the undercover system since there is insufficient clearance to gain access to the top of the undercover system and the undercover system or deck structure has to be at least partly disassembled to clean this debris off of the undercover system.

SUMMARY OF THE INVENTION

These and other problems and disadvantages associated with the prior art are overcome by the invention disclosed herein by providing an undercover system which can be easily assembled or disassembled, which is not supported to the basic deck framework so that the deck structure can be easily repaired without having to remove and reinstall the undercover system, which can be easily cleared of accumulated debris without having to disassemble either the undercover system or the deck structure, which can be simply and easily properly pitched to achieve water runoff, and which requires a minimum of fasteners to install the undercover system so that assembly or disassembly can be quickly achieved even with relatively unskilled labor.

The apparatus of the invention is directed to an undercover system adapted to drain water therefrom for covering a prescribed area associated with a prescribed structure such as an outdoor deck comprising a pair of elongate support assemblies operatively connected to the prescribed structure so that the support assemblies are generally horizontally oriented and spaced apart a prescribed span distance; and at least one elongate self-supporting cover member having opposed ends and a prescribed cover length greater than the span distance adapted to be supported on the support assemblies and span the prescribed span distance between the support assemblies. The invention may also include arresting means operatively associated with the support assemblies and the cover member to maintain the cover member in registration with the support assemblies so that the cover member will be supported on the support means without having to be attached to the support assemblies.

The apparatus of the invention may comprise a plurality of the cover members and interconnect means for selectively interconnecting the cover members in a side-by-side relationship to form a continuous substantially watertight cover over the prescribed space. The arresting means of the invention may include end arresting means operatively associated with the opposed ends of the cover members to maintain the cover members in supporting registration with the support assemblies along a path generally normal to the longitudinal axes of the support assemblies; side arresting means operatively associated with the cover members to maintain the cover members in supporting registration with the support assemblies along a path generally parallel to the longitudinal axes of the support assemblies; and/or top arresting means operatively associated with the cover members to maintain the interconnecting means interconnecting the cover members together in a watertight condition yet allowing the cover members to move vertically a prescribed clearance distance with respect to the support assemblies so that the cover members rest on but are not attached to the support assemblies.

The support assemblies of the invention may further comprise an elongate support element extending along the length of the support assembly and defining an upwardly facing support surface thereon adapted to be engaged by and support one of the opposed ends of the cover member thereon, and spacing support means operatively associated with the prescribed structure and supporting the support element with respect to the prescribed structure so that the support element is generally horizontally oriented generally parallel to the support element of the other support assembly and spaced from the support element of the other support assembly the prescribed span distance. The support element is spaced from the supporting structure mounting the support assembly so that the cover member projects thereover to discharge water through the space between the support element and the supporting structure. The support assemblies of the invention may also include reinforcing support means operatively connected to the support element and operatively associated with the prescribed structure to further support the support element while the cover member is supported on the support element.

The apparatus of the invention may likewise include water collection means operatively associated with at least one of the opposed ends of the cover member to collect the water draining therefrom which may be integrally incorporated in the support assembly. The water collection means may be an upwardly opening water collection gutter channel defined in the spacing support means of the support assembly so that water flowing off of the cover member will flow into and be collected in the gutter channel. Likewise, the apparatus of the invention may include drainage means operatively associated with the gutter channel in the spacing support means to discharge the water collected in the gutter channel therefrom.

The method of the invention is directed to a method of building an undercover system for an elevated deck structure having a horizontal platform exposed to rainfall and upright supports supporting the horizontal platform where the undercover system provides the combined functions of a ceiling and a drainage system for the horizontal platform and a roof for the space located beneath the horizontal platform. The method comprising the steps of attaching at least two gutter members to the upright supports of the ground structure at spaced apart positions below the horizontal platform; and supporting elongate cover members on the gutter members solely by gravity so that the cover members will drain into at least one of the gutter members. The method also contemplates using cover members with complementary nesting configurations along opposite sides thereof and further comprising the step of sequentially placing the cover members on the gutter members while overlapping the nesting configuration along one side of the cover member already supported on the gutter members with the complementary nesting configuration of the next cover member to interconnect the cover members and form a continuous cover under the deck structure.

These and other features and advantages of the invention will become more clearly understood upon consideration of the following detailed description and accompanying drawings wherein like characters of reference designate corresponding parts throughout the several views and in which:

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

Figure 1:
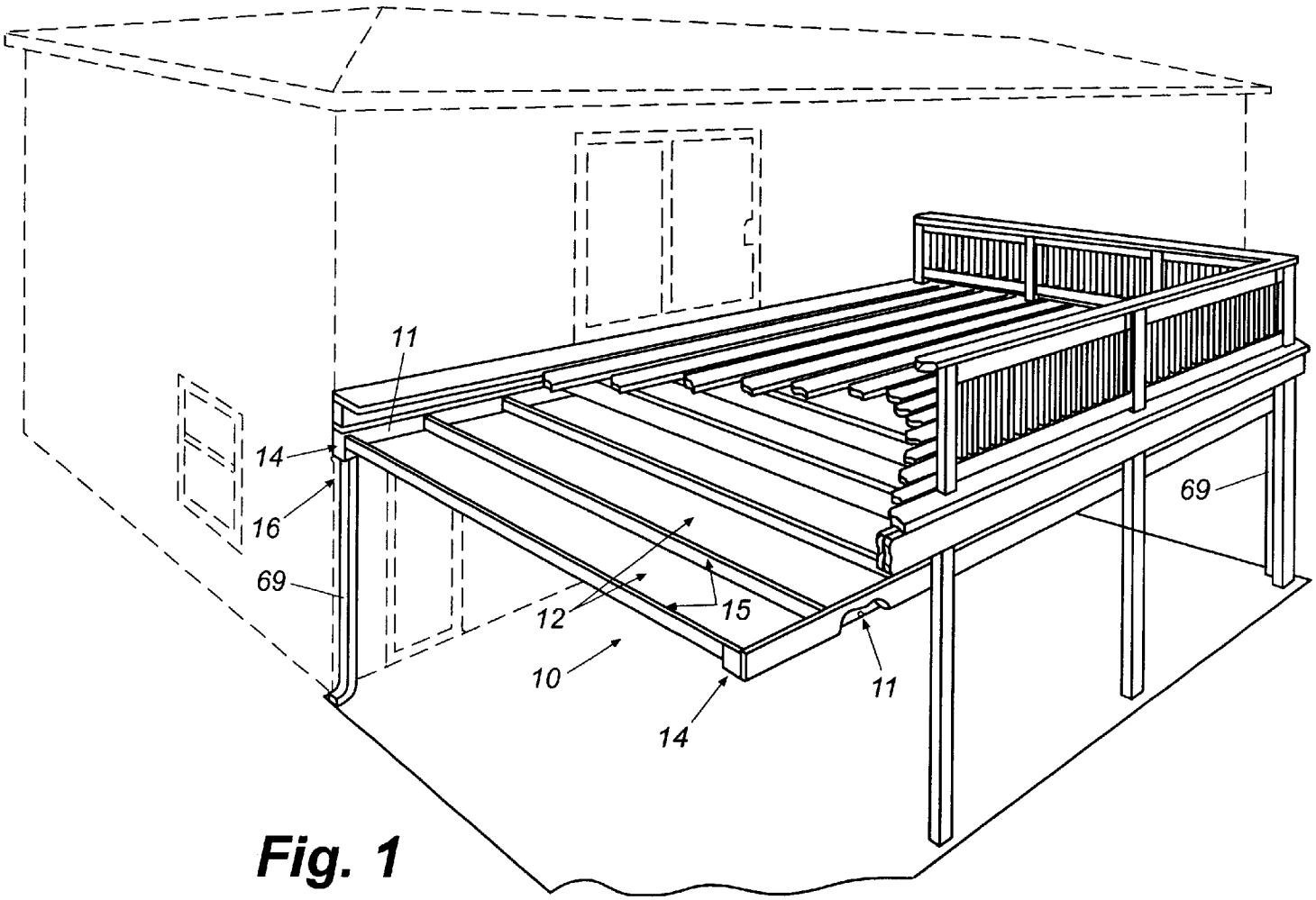
FIG. 1 is a perspective view illustrating the invention installed under a deck structure.

Referring to FIG. 1, it will be appreciated that the invention disclosed herein may be used to cover any prescribed area PA associated with a prescribed structure PS. While the apparatus of the invention is illustrated as an undercover system 10 for an elevated deck structure DS on a building BG, it is not limited to this application an may be used as a cover for any prescribed area.

In the wooden deck structure DS illustrated in FIG. 1, there is provided a deck frame DF supported along one side on the building BG and along the other side by posts PT. The deck frame DF is of conventional construction with headers HD along opposite sides of the deck structure between which deck joists DJ extend and are affixed. A plurality of wood floor members FM extend across and are affixed to the tops of the deck joists DJ. Typically, the floor members FM are spaced apart so as to allow expansion and contraction of the floor members due to temperature and moisture and to allow the floor members to dry out. This allows water and debris to pass therethrough into the prescribed area PS below the deck structure DS. Thus, the deck structure DS is a horizontal platform with the prescribed are a PA to be covered located therebelow.

The undercover system 10 is mounted below and separate from the deck frame DF and serves to keep the water and debris passing through the deck structure DS off of the prescribed area PA. While different mounting arrangements may be used, the undercover system 10 is illustrated mounted between the wall WL of the building BG and the posts PT holding the deck frame DF. The undercover system 10 provides the combined functions of a ceiling and a drainage system for the horizontal platform and a roof for the space located beneath the horizontal platform.

The undercover system 10 comprises generally at least a pair of support assemblies 11 mounted at spaced apart positions and generally horizontally oriented on which are supported a plurality of cover members 12. While the undercover system 10 is illustrated as a single section, it will be appreciated that the undercover system 10 may be made in different sections that are connected together to form the complete undercover system. Arresting means 14 is provided to keep the cover members 12 in registration with the support assemblies 11 so that the cover members 12 are supported by the support assemblies 11 without having to be attached thereto as will become more apparent. Interconnect means 15 is also provided to interconnect the cover members 12 in a side-by-side watertight relationship so that the cover members 12 act as a continuous cover for the prescribed area PA under the deck structure DS. Usually, water collection means 16 is provided to collect the water discharged from the cover members 12. The water collection means 16 may be separate or incorporated in the support assemblies 11 as illustrated in the drawings.

Figure 2:
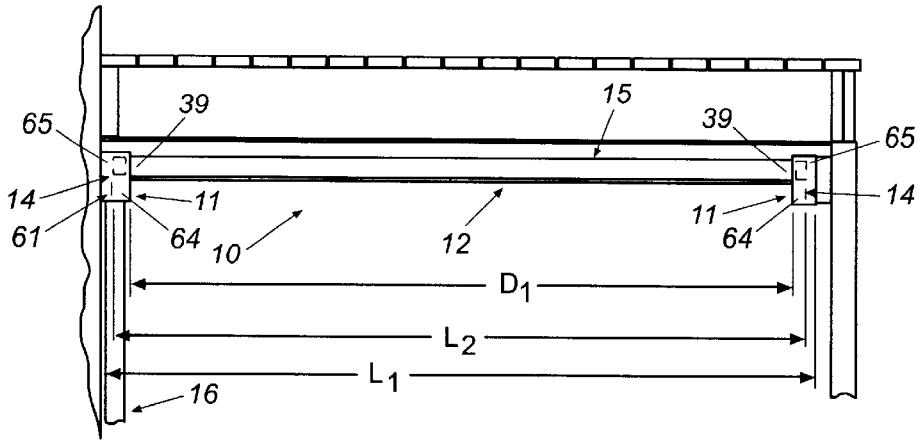
FIG. 2 is a transverse cross-sectional view of the invention of FIG. 1.

As best seen in FIG. 2, the support assemblies 11 are located so as to define a prescribed span distance $D_1$ therebetween. A clearance space CS is defined above the support assemblies 11 which receives the cover members 12. The clearance space CS has a length $L_1$ greater than the span distance $D_1$, usually greater by twice the transverse dimension $D_2$ (seen in FIG. 4) of the support assemblies 11. The cover members 12 have a length $L_2$ which allows them to be received above and extend over the support assemblies 11 but which is sufficient to prevent the cover members 12 from falling off of the support assemblies 11 when the cover member 12 abuts one end of the space CS. In this particular instance, the length $L_2$ is just longer than the length $L_1$ of the space CS minus the transverse dimension $D_2$ of one of the support assemblies 11.

Figure 4:
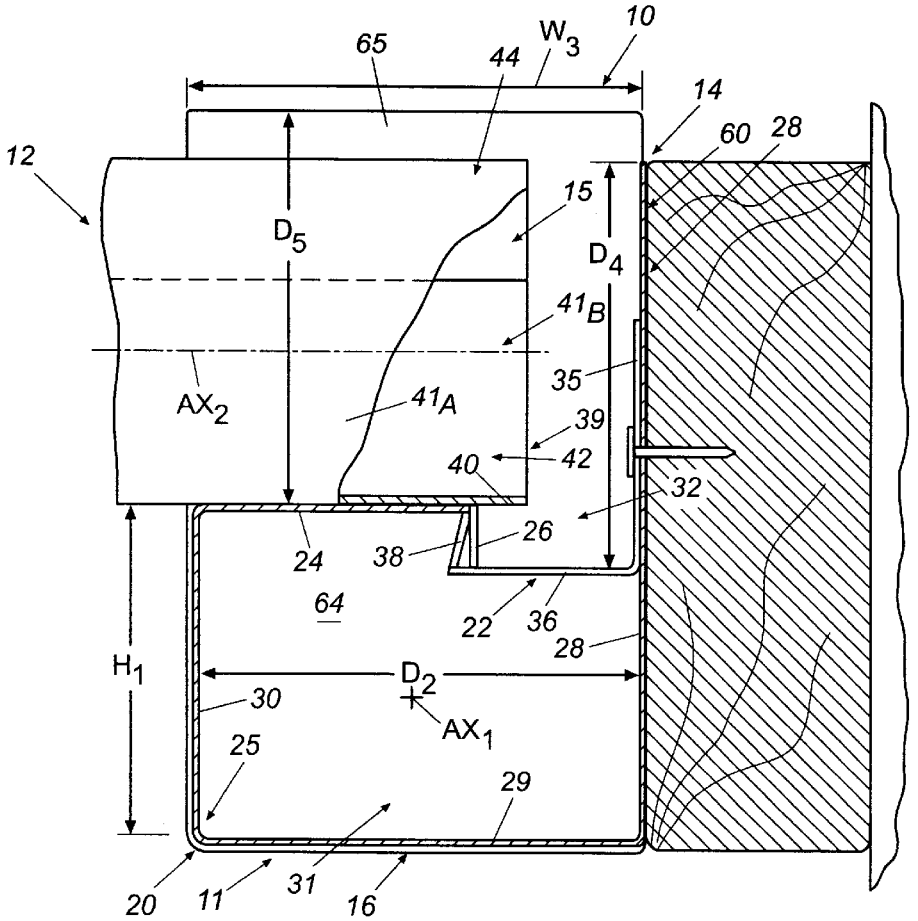
FIG. 4 is a transverse cross-sectional view of the support assembly taken generally along line 4—4 in FIG. 3.
Figure 3:
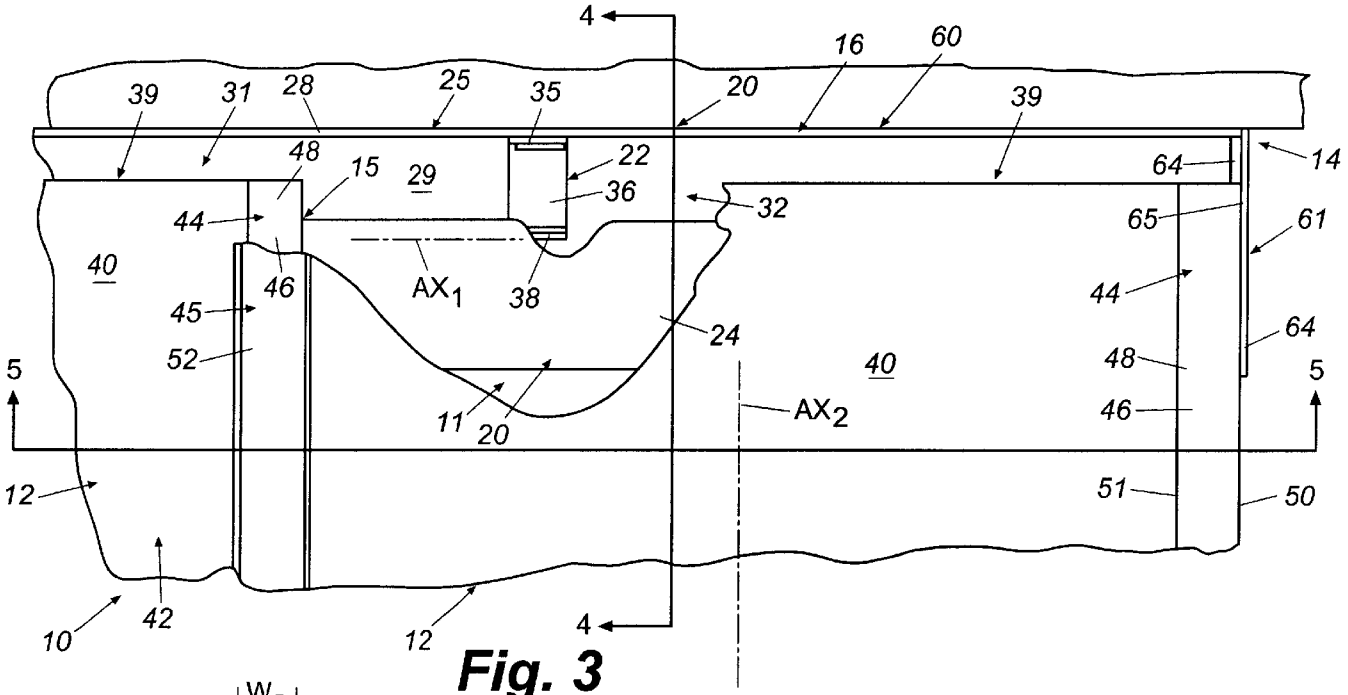
FIG. 3 is an enlarged partial top view of one of the support assemblies of the invention.

As best seen in FIGS. 3 and 4, each of the support assemblies 11 includes a gutter member 20 with central axis $AX_1$ that serves as the basic support for the end of the cover members 12 and may include auxiliary support means 22 illustrated as auxiliary support brackets that serve to provide additional support for the gutter member 20. The gutter member 20 includes an elongate support element 24 that is positioned by a spacing support means 25. While the gutter member 20 may have different configurations, the support element 24 is illustrated as a generally flat support flange 24 that is folded back over the spacing support means 25 and has a depending reinforcing lip 26 on the projecting edge of the flange 24 that extends along the length thereof.

The particular spacing support means 25 illustrated includes an upstanding mounting leg 28 that extends along the length of the gutter member 20, a bottom section 29 integral with the lower edge of the mounting leg 28 and oriented generally normal to the plane of the leg 28, and an upstanding spacer leg 30 integral with the projecting edge of the bottom section 29 opposite the mounting leg 28. The spacer leg 30 is oriented generally normal to the plane of the bottom section 29 and projects upwardly from the bottom section 29 in the same direction as the mounting leg 28 so that the spacing support means 25 has a generally U-shaped cross-sectional shape. The upper projecting edge of the spacer leg 30 is integral with that edge of the support flange 24 opposite the reinforcing lip 26 so that the support flange 24 extends back over the bottom section 29 is and spaced thereabove a prescribed gutter channel defining height $H_1$ so that a gutter channel 31 is defined along the length of the gutter member 20 with an opening 32 thereinto between the edge of the support flange 24 and the mounting leg 28 through which water discharged off of the cover members 12 passes into the gutter channel 31.

The upstanding mounting leg 28 is used to mount the gutter member 20 and is usually attached to a convenient wall WL or to the posts PT associated with the deck structure DS. In the particular instance shown in the drawings, an auxiliary mounting member MM is attached to the posts PT and the mounting leg 28 then is mounted on the mounting member MM using conventional fasteners FT such as galvanized, coated or noncorroding nails or screws to allow more points of attachment for the gutter member 20. The gutter member is designed with sufficient strength to support the weight of the cover members 12 supported thereon. To insure that the strength is sufficient, 20–24 gauge steel or 0.040 inch. aluminum is typically used where the cover member span being supported is about 10–18 feet.

A first embodiment of the auxiliary support bracket 22 is shown in FIGS. 3 and 4. The brackets 22 are relatively narrow members that are placed at spaced apart positions along the length of the gutter member 20 so that the water and debris can freely pass therearound and fall into the gutter channel 31. The bracket 22 illustrated has an upstanding attachment leg 35 fastened to the structure mounting the gutter member 20 using the same fasteners FT used to mount the gutter member 20. It will be understood, however, that any convenient means may be used to mount the brackets 22. A bracing leg 36 integral with the lower portion of the attachment leg 35 projects outwardly from the leg 35 across the opening 32 to the gutter channel 31 and under the reinforcing lip 26 on the support flange 24. An upturned projection 38 integral with the projecting end of the bracing leg 36 extends upwardly therefrom behind the lip 26 to engage the support flange 24 at its juncture with the lip 26. This serves to give added support to the support element 24 and thus reinforce the support of the cover members 12.

The cover members 12 are designed to be self supporting so that they only need to be supported from the opposite ends thereof. It will be appreciated that the strength of the cover members 12 necessary to be self-supporting will be dependent on the free span of the cover members. The cross-sectional shape of the cover member 12 as well as the sheet thickness thereof has an effect on the overall strength of the cover member. In the particular configuration illustrated the sheet thickness is usually about 20–24 gauge for steel and about 0.40 inch for aluminum for span s of about 10–18 feet.

Figure 5:
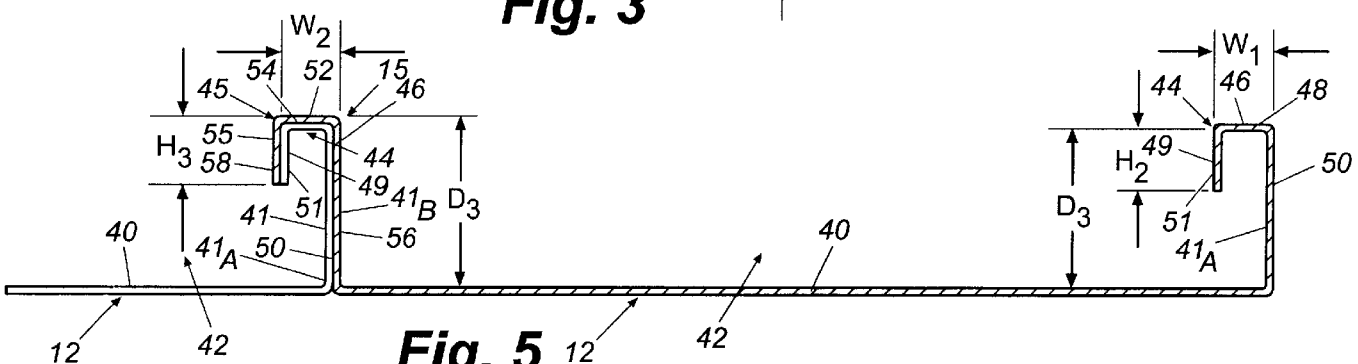
FIG. 5 is a transverse cross-sectional view of the cover members taken generally along line 5—5 in FIG. 3.

The cover member 12 illustrated includes an elongate base sheet 40 with longitudinal axis $AX_2$ and a pair of upstanding reinforcing legs 41 integral with and along opposite sides thereof as best seen in FIG. 5. The legs 41 serve to strengthen the weight carrying capability of the cover member 12 while at the same time forming a water directing channel 42 along the length of the member 12. The transverse width of the base sheet 40 is selected so that the cover member 12 is self-supporting a t the sp an selected for the undercover system. While different widths may be selected, a width of about 12–18 inches has been found satisfactory for the typical spans encountered for the cover system 10. The cover members 12 are designed to be placed in a side-by-side relation ship with each reinforcing leg 41 juxtaposed along a reinforcing leg 41 of an adjacent cover member 12.

The interconnect means 15 is incorporated in the cover members 12 so that the cover members 12 are maintained in a side-by-side relationship to form a continuous substantially watertight cover over the prescribed space PA. While the interconnect means 15 may have a variety of configurations without departing from the scope of the invention disclosed herein, the interconnect means 15 is illustrated as a nesting arrangement with an underlying nesting configuration 44 along the upstanding edge of one of the reinforcing legs $\mathbf{41}_A$ and a complementary overlying nesting configuration 45 along the upstanding edge of the other of the reinforcing legs $\mathbf{41}_B$. When the cover members 12 are installed, they are all turned the same way so that each underlying configuration 44 will underlie the overlying configuration 45 of that cover member 12 adjacent the configuration 44 while the overlying configuration 45 along the opposite side of the cover member 12 will overlie the underlying configuration 44 of that cover member 12 adjacent the configuration 45. Thus, the placement of the cover members 12 is ordered so that the underlying configuration 44 of each cover member 12 positioned on the support assemblies 11 is left exposed in order that the overlying configuration 45 of the next cover member 12 being placed during assembly can overlap the exposed configuration 44 to allow the configurations 44 and 45 of the two cover members 12 to nest. The nesting configurations 44 and 45 form a watertight joint between the cover members 12 even though the nesting configurations are not sealed to each other because the configurations 44 and 45 are located above upper surface of the bottom sheet 40 where the water is collected and because the cross-sectional shape of the configurations 44 and 45 prevents the water from entering the interface between the configurations.

While different shaped underlying configurations 44 may be used without departing from the scope of the invention, the underlying configuration 44 illustrated in FIGS. 4 and 5 includes an elongate underlying flange 46 integral with the upstanding edge of the reinforcing leg $\mathbf{41}_A$ along one side of the cover member 12 and projecting out over and generally parallel to the base sheet 40 of the cover member. The top surface 48 of the flange 46 is located a distance $D_3$ above the bottom of the cover member 12, i.e. the bottom surface of the base sheet 40. While the distance $D_3$ may vary, about 2–4 inches has been found to work satisfactory within the parameters of the invention. A locating lip 49 is integral with the projecting edge of the flange 46 and depends therefrom. The lip 49 is illustrated generally parallel to the leg $\mathbf{41}_A$ with a convenient height $H_2$ illustrated at about 1–2 inches. The cross-sectional width $W_1$ of the underlying configuration 44 is the distance between the outside surface 50 of the leg $\mathbf{41}_A$ and the outside surface 51 of the lip 49 as best seen in FIG. 5 and is illustrated as about 0.75–1.5 inches.

While different shaped overlying configurations 45 may be used without departing from the scope of the invention as long as they are complementary to the configuration 44, the overlying configuration 45 illustrated in FIGS. 4 and 5 includes an elongate overlying flange 52 integral with the upstanding edge of the reinforcing leg $\mathbf{41}_B$ along that side of the cover member 12 opposite leg $\mathbf{41}_A$ and projecting outwardly therefrom generally parallel to the base sheet 40 but in the opposite direction from the leg $\mathbf{41}_B$. The bottom surface 54 of the flange 52 is located the same distance $D_3$ above the bottom of the cover member 12, i.e. the bottom surface of the base sheet 40 as that of the surface 48 on the configuration 44. A nesting lip 55 is integral with the projecting edge of the flange 52 and depends therefrom. The lip 55 is illustrated generally parallel to the leg $\mathbf{41}_B$ with a convenient height $H_3$ illustrated at about that of the lip 49.

The inside cross-sectional width $W_2$ of the overlying configuration 45 is the distance between the outside surface 56 of the leg $\mathbf{41}_B$ and the inside surface 58 of the lip 52 as best seen in FIG. 5 and is illustrated about the same as the width $W_1$ of the underlying configuration 44. Thus, the upwardly facing outside shape and size of the underlying configuration 44 is complementary to the downwardly facing inside shape and size of the overlying configuration 45 so that these configurations on adjacent cover members 12 will nest over each other. The nesting arrangement 15 thus keeps adjacent cover members 12 interconnected while at the same time forming a watertight joint between the cover members. When the cover members 12 are interconnected, the bottom surfaces of the base sheets 40 are generally coplanar to form the exposed substantially continuous ceiling surface over the prescribed area PA.

As mentioned hereinabove, the cover members 12 are supported on the support assemblies 11 but usually not fixedly attached there to. This allows a user to push up the ends of the cover members 12 to change the slope of the base sheets 40 and allow debris to be flushed off of the cover members 12 and also to allow easy access to the gutter channel 31 in the gutter members 20 for cleaning.

Figure 6:
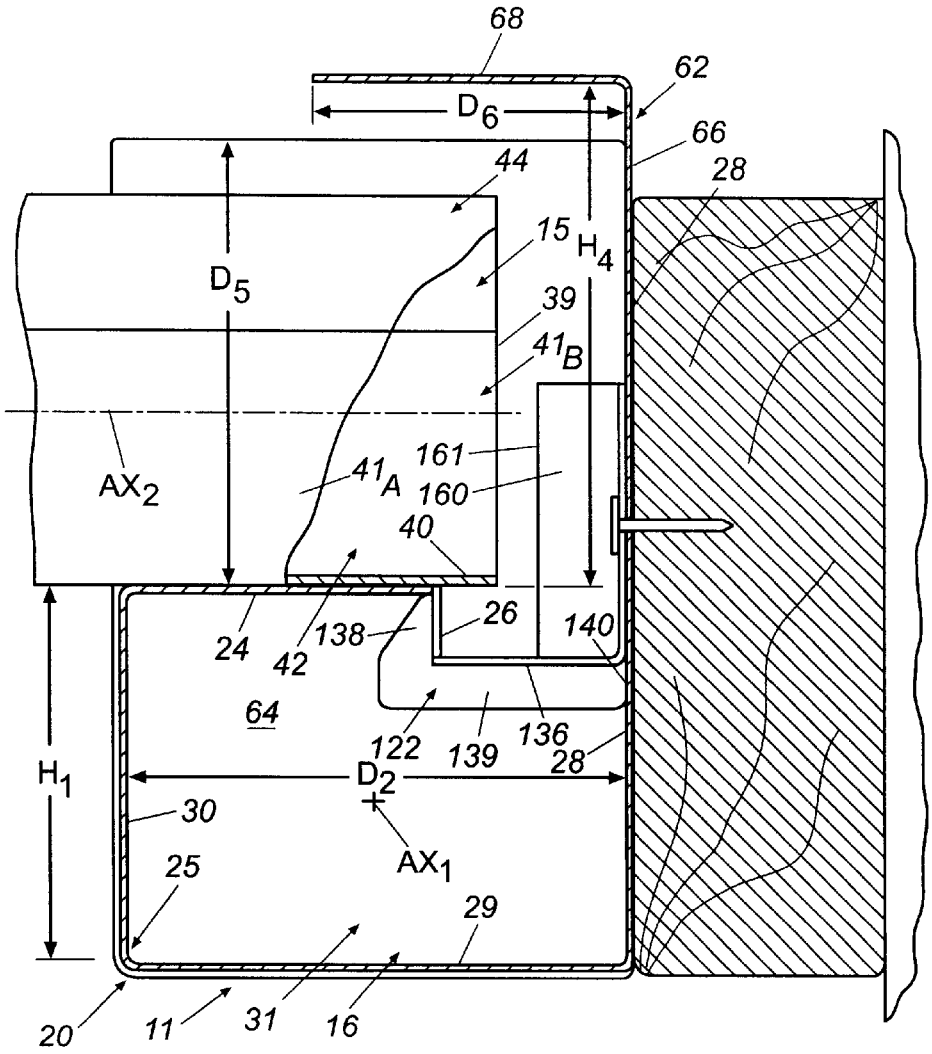
FIG. 6 is a view similar to FIG. 4 showing the top arresting means; and, FIG. 7 is a perspective view of the second embodiment of the auxiliary support member.

Even though the cover members 12 are not attached to the support assemblies 11, the arresting means 14 serves to keep the cover members 12 in registration with the support assemblies 11 as the cover members 12 move relative to the support assemblies. While the arresting means 14 may take various forms without departing from the scope of the invention, it is illustrated in FIGS. 3 and 4 as comprising end arresting means 60 operatively associated with the opposed end portions 39 of the cover members 12 to maintain the cover members in supporting registration with the support assemblies 11 lengthwise of the cover members 12 (i.e., along a path generally normal to the longitudinal axes $AX_1$ of the support assemblies 11, The arresting means 14 is also illustrated in FIGS. 3 and 4 as including side arresting means 61 operatively associated with the cover members 12 to maintain cover members in supporting registration with the support assemblies 11 transversely of the cover members 12 (i.e., along a path generally parallel to the longitudinal axes $AX_1$ of the support assemblies). The arresting means 14 is also illustrated in FIG. 6 as including top arresting means 62 operatively associated with the cover members 12 to maintain the interconnecting means 15 interconnecting the cover members together in a watertight condition yet allowing the cover members to move vertically a prescribed clearance distance with respect to the support assemblies 11 so that the cover members rest on but are not attached to the support assemblies yet will not be able to be accidentally dislodged from the support assemblies 11.

The end arresting means 60 may take a variety of forms without departing from the scope of the invention. It is illustrated in FIGS. 3 and 4 as being incorporated in the upstanding mounting leg 28 on the gutter member 20. The height of the mounting leg 28 is selected so that it projects above the plane of the support flange 24 a prescribed projection distance $D_4$, illustrated as about 2–4 inches. The distance $D_4$ is selected such that the base sheet 40 is unlikely to raise above the top of the mounting leg 28. In applications under decks, the above dimensions have been found to be adequate. Thus, the end portion 39 of the cover member 12 will abut the mounting leg 28 before the opposite end 39 of the cover member falls off of the opposite support assembly 11.

The side arresting means 61 may take a variety of forms without departing from the scope of the invention. It is illustrated in FIGS. 3 and 4 as being incorporated in the gutter end caps 64 used to close the opposite ends of the gutter members 20. Each of the end caps 64 is provided with an upstanding extension 65 that projects above the plane of the support flange 24 a prescribed projection distance $D_5$ which is usually about that of the mounting leg 28. The transverse width $W_3$ of the extension 65 is selected to insure that the extension will remain in engagement with the sides of the cover member 12 adjacent thereto as it slides back and forth between the mounting legs 28.

The top arresting means 62 is designed to be used in those situations where the cover members 12 may be displace vertically sufficiently for the interconnecting means 15 to become detached. In under deck applications, the bottom of the deck frame DF will usually act as the top arresting means. While the top arresting means 62 may have a variety of different configurations without departing from the scope of the invention, it is illustrated in FIG. 6 as including an extension 66 of the mounting leg 28 provided with an overlying top flange 68 integral with the upper edge of the extension 66 and extending back over the end 39 of the cover member 12. The height $H_4$ of the flange 68 above the plane of the support flange 24 is selected to limit the upward movement of one of the cover members 12 relative to the adjacent cover member sufficiently to prevent the nesting arrangement 15 from disengaging. The projection distance $D_6$ of the flange 68 back over the cover member 12 is sufficient to prevent the end 39 of the cover member 12 clearing the flange as the cover member 12 moves back and forth relative to the support assemblies 11.

Figure 7:
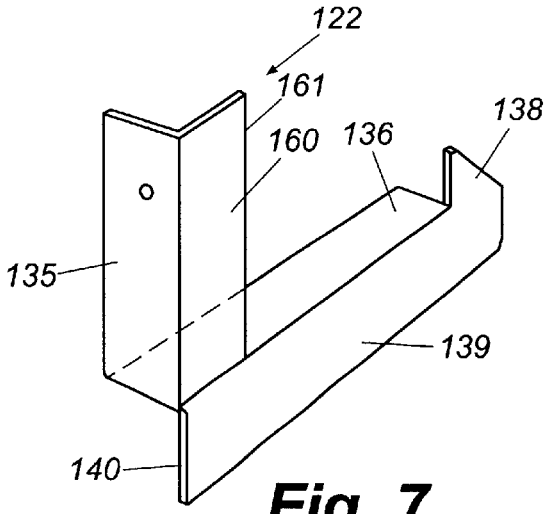

A second embodiment of the auxiliary support means, designated 122, is illustrated in FIGS. 6 and 7. The support means 122 is also in the form of an auxiliary support bracket with an upstanding attachment leg 135, bracing leg 136 and upturned projection 138 corresponding to the similar parts of the bracket 22. In addition, the bracing leg 136 of the bracket 122 is provided with a depending reinforcing flange 139 integral with one side of the bracing leg 136 and with the upturned projection 138 formed as a continuation of the flange 139. The near end 140 of the flange 139 also serves as an abutment to bear against the upstanding mounting leg 28 of the gutter member 20 and further support the projection 138.

A spacer flange 160 integral with the attachment leg 135 may be provided to serve as the end arresting means for the cover members 12. The flange 160 is oriented normal to the axis $AX_1$ of the gutter member 20 so that its projecting edge 161 will be engaged by the end 39 of the cover member 12 to keep a gap between the cover member 12 and the upstanding mounting leg 28 of the gutter member 20 to insure drainage off of the cover member 12. The configuration of the bracket 122 is such that it can be made from a single flat sheet of material.

The water collection means 16 is illustrated as being incorporated in the support assemblies 11 although it is to be understood that the collection means may be separate. The water collection means 16 comprises the gutter channels 31 defined in the gutter members 20 along with the end caps 64 closing opposite ends of the gutter channels 31. Drainage means 69 is provided for draining the water collected in the channels 31. As best seen in FIG. 1, the drainage means 69 is in the form of a downspout in the end of the channels 31 to direct the collected water out from the prescribed area.

To install the undercover system 10, the installer attaches the auxiliary mounting member MM at a prescribed spacing distance $D_{SD}$ below the deck frame DF as best seen in FIGS. 1 and 2. Next, the gutter members 20 are installed on the building wall WL and the mounting member MM so that the support flanges 24 are generally horizontally oriented (there may be a slight slope for drainage purposes) and are usually spaced from each other a common distance. The gutter members 20 may be horizontally aligned as shown or offset vertically with respect to each other to give the desired slope to the cover members 12. The support brackets 22 or 122 are installed to maintain the support flanges 24 in place during use. Next, the installer cuts the cover members 12 to length so that they will fit in the clearance space CS above the support flanges 24 on the gutter members 20. The installer then places one of the cover members 12 on the tops of the support flanges 24 of the gutter members 20 with the overlying configuration 45 leading, and slides it along perpendicular to its central axis $AX_2$ until the trailing underlying configuration 44 is located with enough clearance above it for the overlying configuration 45 of the next cover member 12 being installed to be placed over the already placed underlying configuration 44. The next cover member 12 is then installed by placing the overlying configuration 45 over the trailing underlying configuration 44 and lowering configuration 45 to nest over configuration 44. The next cover member 12 along with the already placed cover member 12 is then pushed onto the gutter members 20 until the trailing underlying configuration 44 thereon is just outboard of the gutter members 20. This process is repeated until the number of cover members 12 sufficient to cover the prescribed area PA are in position.

What is claimed as invention is:

1. An undercover system adapted to drain water therefrom for covering a prescribed area associated with a prescribed structure, said system comprising:

a pair of elongate support assemblies for attachment to a prescribed structure so that said support assemblies are generally horizontally oriented and spaced apart a distance from each other;

a pair of elongate gutter members supported along their lengths by said elongate support assemblies and spaced apart a distance from each other; and at least one elongate self-supporting cover member having opposed ends and being of a length greater than the distance between said gutter members and being freely mounted at its ends on said gutter members and being movable upwardly from said gutter members and spanning the distance between said gutter members.

2. The undercover system of claim 1 further comprising:

arresting means operatively associated with said support assemblies and said cover member to maintain said cover member in registration with said gutter members so that said cover member will be supported on said gutter members.

3. The undercover system of claim 1 wherein said at least one elongate self-supporting cover member includes a plurality of said cover members, each of said cover members including interconnect means for selectively interconnecting said cover members in a side-by-side relationship to form a substantially continuous watertight cover over a prescribed space.

4. The undercover system of claim 3 further comprising:

end arresting means operatively associated with said opposed ends of said cover members to maintain said cover members in supporting registration with said gutter members, said end arresting means being positioned along a path generally normal to the longitudinal axes of said gutter members.

5. The undercover system of claim 4 further comprising:

side arresting means operatively associated with said cover members to maintain said cover members in supporting registration with said gutter members, said side arresting members being positioned along a path generally parallel to the longitudinal axes of said cover members.

6. The undercover system of claim 5 further comprising:

top arresting means operatively associated with said cover members to maintain said interconnect means interconnecting said cover members together in a watertight condition yet allowing said cover members to move vertically a prescribed clearance distance with respect to said support assemblies so that said cover members rest on but are not attached to said support assemblies.

7. The undercover system of claim 1 wherein said gutter members each defines an upwardly opening water collection gutter channel therein so that water flowing off of said cover member will flow into and be collected in said gutter channel.

8. The undercover system of claim 7 further comprising:

drainage means operatively associated with said gutter channel in said spacing support means to discharge the water collected in said gutter channel.

9. The undercover system of claim 1 wherein said gutter members each define an upwardly facing cover support surface thereon adapted to engage and support said cover member and wherein said cover member rests on said cover support surface without being attached thereto so that said cover member can be selectively forced upwardly from said cover support surface but again rests on said support surface when the upward force is removed.

10. The undercover system of claim 3 wherein said interconnect means comprises nesting means for connecting said cover members in a side-by-side relationship while allowing limited relative movement between said cover members and maintaining a watertight connection therebetween.

11. The undercover system of claim 10 wherein said cover members each has opposed generally parallel sides and wherein said nesting means includes:

an underlying nesting configuration along one of said sides of said cover member and having a first transverse cross-sectional configuration; and, an overlying nesting configuration along the opposite of said sides of said cover member and having a second transverse cross-sectional configuration complementary to said first transverse cross-sectional configuration such that, when a plurality of said cover members are arranged in a side-by-side relationship, said overlying nesting configuration of one of said cover members will nest over and said underlying nesting configuration of an adjacent one of said cover members to form a watertight connection between said adjacent cover members.

12. A deck system comprising:

a) an elevated deck structure including:

a1) a deck frame having a top, and a2) a plurality of floor members attached to the top of said deck frame;

b) support means for supporting said deck structure in an elevated position; and c) an undercover system adapted to drain water therefrom mounted on said support means under said deck structure comprising:

c1) a pair of elongate gutter members mounted on said support means below said deck structure at spaced apart positions with respect to each other; and, c2) a plurality of elongate self-supporting cover members having opposed ends and sides, and a prescribed cover length greater than the distance between said gutter members supported on said gutter members to form a watertight covering under said deck structure.

13. The deck system of claim 12 wherein said undercover system further comprises:

c3) arresting means for maintaining said cover members in registration with said gutter members while allowing said cover members to move relatively to said gutter members so that said cover members will be supported on said gutter members.

14. The deck system of claim 12 wherein said undercover system further comprises:

c4) nesting means for interconnecting said cover members including:

c4.1) an underlying nesting configuration along one of said sides of said cover member and having a first transverse cross-sectional configuration, and c4.2) an overlying nesting configuration along the opposite of the sides of said cover member and having a second transverse cross-sectional configuration complementary to said first transverse cross-sectional configuration such that, when a plurality of said cover members are arranged in a side-by-side relationship, said overlying nesting configuration of one of said cover members will nest over and said underlying nesting configuration of an adjacent one of said cover members to form a watertight connection between said adjacent cover members.

15. A method of building an undercover system for an elevated deck structure having a horizontal platform and upright supports supporting the horizontal platform, the undercover system providing combined functions of ceiling and drainage system for the horizontal platform and roof for space located beneath the horizontal platform, said method comprising the steps of:

a) attaching at least two gutter members to the upright supports at spaced apart positions below the horizontal platform; and, b) supporting elongate cover members on said gutter members solely by gravity so that said cover members will drain into at least one of the gutter members.

16. The method of claim 15 wherein said cover members have complementary nesting configurations along opposite sides thereof and further comprising the step of:

c) sequentially placing said cover members on said gutter members while overlapping the nesting configuration along one side of the gutter member already supported on said gutter members with the complementary nesting configuration of the next cover member to interconnect said cover members and form a continuous cover under said deck structure.

* * * * *